US006557538B2

(12) United States Patent
Munz et al.

(10) Patent No.: US 6,557,538 B2
(45) Date of Patent: May 6, 2003

(54) METHOD FOR FORMING CONTACT BETWEEN A CONTROL UNIT AND CURRENT LOADS OF INTERNAL COMBUSTION ENGINES

(75) Inventors: Dietmar Munz, Kernen (DE); Thomas Stolk, Kirchheim/Teck (DE); Steffen Walter, Wangen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/948,241

(22) Filed: Sep. 6, 2001

(65) Prior Publication Data

US 2002/0043256 A1 Apr. 18, 2002

(30) Foreign Application Priority Data

Sep. 6, 2000 (DE) ..... 100 43 804

(51) Int. Cl.[7] ..... F02P 1/00
(52) U.S. Cl. ..... 123/635; 123/647; 123/143 C
(58) Field of Search ..... 123/143 C, 634, 123/647, 635, 643

(56) References Cited

U.S. PATENT DOCUMENTS 5,771,850 A * 6/1998 Okada ..... 123/143 C

FOREIGN PATENT DOCUMENTS

| | | |
|---|---|---|
| DE | 42 25 329 | 2/1993 |
| DE | 198 54 542 | 4/2000 |

* cited by examiner

*Primary Examiner*—Henry C. Yuen
*Assistant Examiner*—Johnny H. Hoang
(74) *Attorney, Agent, or Firm*—Kenyon & Kenyon

(57) ABSTRACT

In order to form contact between a control unit and current loads of an internal combustion engine by electrical components through a cylinder head cover which is seated on a cylinder head of the internal combustion engine, a method includes a pre-fixing step for the electrical components, from which step the electrical components are moved into a fixed position directly or indirectly in the cylinder head cover, after the cylinder head cover has been fitted onto the cylinder head, in order to subsequently connect the electrical components to the control unit.

10 Claims, 3 Drawing Sheets

METHOD FOR FORMING CONTACT BETWEEN A CONTROL UNIT AND CURRENT LOADS OF INTERNAL COMBUSTION ENGINES

FIELD OF THE INVENTION

The present invention relates to a method and a device for forming contact between a control unit and current loads of internal combustion engines.

BACKGROUND INFORMATION

German Published Patent Application No. 42 25 329 describes a device for forming contact between a control unit and actuators of an electromagnetic valve controller. The internal combustion engine has a cylinder head in which gas exchange valves, which are activated by the electromagnetic actuators, are arranged, the cylinder head being covered by a cylinder head cover. The actuators include opening and closing magnets which are actuated by the control unit. For this purpose, each actuator has a cable which extends from the respective actuator within the cylinder head cover to a recess in the cylinder head cover through which the cable is subsequently plugged in order to be connected to the control unit.

A significant disadvantage of the device is the complex mounting of the internal combustion engine because the cables must be extended individually to the recess in the cylinder head. Moreover, when the cylinder head cover is fitted on, the cables which are loosely guided in the cylinder head cover can be squashed.

German Published Patent Application No. 198 54 542 also describes a device for forming contact between a control unit and actuators of an electromagnetic valve controller. The internal combustion engine has a cylinder head which is composed of three housing components, the actual cylinder head, a frame part which is connected with flanges to the cylinder head and a cylinder cover which can be fitted onto the frame part. The formation of contact between the control unit and the actuators is made by electrical components through the frame part, the electrical components being at least partially integrated into the frame part.

It is an object of the present invention to reduce the mounting effort incurred in forming contact between a control unit and current loads of an internal combustion engine, to simplify the mounting operations generally, and to reduce as much as possible the installation space required.

SUMMARY

The above and other beneficial objects of the present invention are achieved by providing a method and a device as described herein.

A significant advantage of the present invention is the optimization of the mounting operations. The electrical components or contact-forming housings which are required for the formation of contact between the control unit and the current loads of the internal combustion engine are in respectively predefined positions during the entire mounting operation, i.e., the electrical components of the current loads or the contact-forming housings merely have to be moved during the mounting from a predefined prefixed position on the current load into a predefined fixed position indirectly or directly in the cylinder head cover, after which it is possible to form contact between the current loads and the control unit in the fixed position without difficulty.

Control units and in particular valve control units are appropriately attached to the cylinder head cover. The formation of contact between the control unit, spanning the entire cylinder bank, and the current loads is subject to large tolerances. The floating fixing of the contact-forming housing in the cylinder head cover or in an intermediate frame which is supported in the cylinder head cover therefore permits virtually all the tolerances which originate from the current loads or the mounting thereof on the cylinder head to be equalized, as a result of which subsequent processing of the mounting components in order to reduce tolerances is no longer necessary.

The use of the intermediate frame permits further reduction of the tolerances by group-formation of the contact-forming housings in that a long tolerance chain is split up into a plurality of small tolerance chains. The actual formation of contact between the contact-forming housing and the control unit is made easier by a receptacle in the intermediate frame into which the control unit is latched and may then be pivoted in this receptacle onto the contact-forming housing or guided into the contact-forming housings, which results in an additional reduction in the tolerances and to a reduction in the contact-forming forces.

While the internal combustion engine is operating, the actuators are subjected to extreme vibration loading, which may result in functional faults if the contact-forming housings were connected directly to the actuators. By virtue of the fact that the contact-forming housings are connected to the actuators via leads or cables and do not have any direct contact with the actuators, there is a decoupling between the actuator and contact-forming housing, permitting the latter to function in an undisrupted way.

DETAILED DESCRIPTION

Figure 1A:
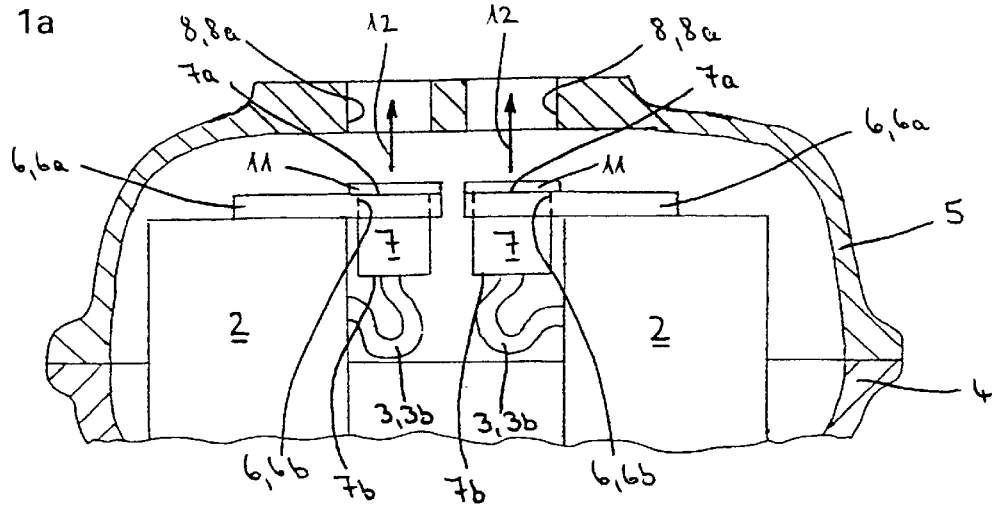
FIG. 1*a* is a cross-sectional view of a first example embodiment of a device according to the present invention during a pre-fixing of contact-forming housings.

Firstly, brief details will be given on the common features of the different example embodiments (illustrated in FIGS. 1*a* to *c* and 2*a* to *c*) of devices for forming contact between a control unit, in particular a valve control unit 1, and current loads 2 of a multi-cylinder internal combustion engine by electrical components 3, the internal combustion engine having a cylinder head 4 onto which a cylinder head cover 5 may be fitted. FIGS. 1*a* to 1*c* and 2*a* to 2*c* illustrate the devices in the respective method steps of contact formation.

The devices for forming contact include at least one pre-fixing device 6 attached to the current load 2, at least one contact-forming housing 7 which partially encloses the electrical components 3, and at least one fixing device 8 provided indirectly or directly on the cylinder head cover 5.

The current loads are, in particular, ignition coils and actuators 2, described in more detail below, of an electromagnetic valve controller having the electrical components 3 which are required for the formation of contact and which have current-load-end couplings 3*a* (FIG. 2*d*) and leads or cables 3*b* which connect current loads 2 and couplings 3*a*, at least one coupling 3*a* being arranged in a contact-forming housing 7 and being capable of receiving a plug 9 of the control unit 1.

The actuators 2 include opening and closing magnets which are actuated by the valve control unit 1. The actuators 2 activate gas exchange valves which control corresponding gas exchange ducts.

A securing device 6*a* which is attached to the respective current load 2 and includes a recess 6*b* in which the contact-forming housing 7 is inserted with its plug side 7*a* in the direction of the cylinder head cover 5 and with its cable side 7*b* in the direction of the current load 2 is provided as the pre-fixing device 6, a movement of the contact-forming housing 7 in the contact-forming direction 10, i.e., in the direction of the cylinder head 4, being prevented due to latching elements 11 which are provided on the plug side 7*a* of the contact-forming housing 7, and a movement in the direction 12 opposed to the contact-forming direction 10, i.e., in the direction of the cylinder head cover 5, being made possible.

Figure 1B:
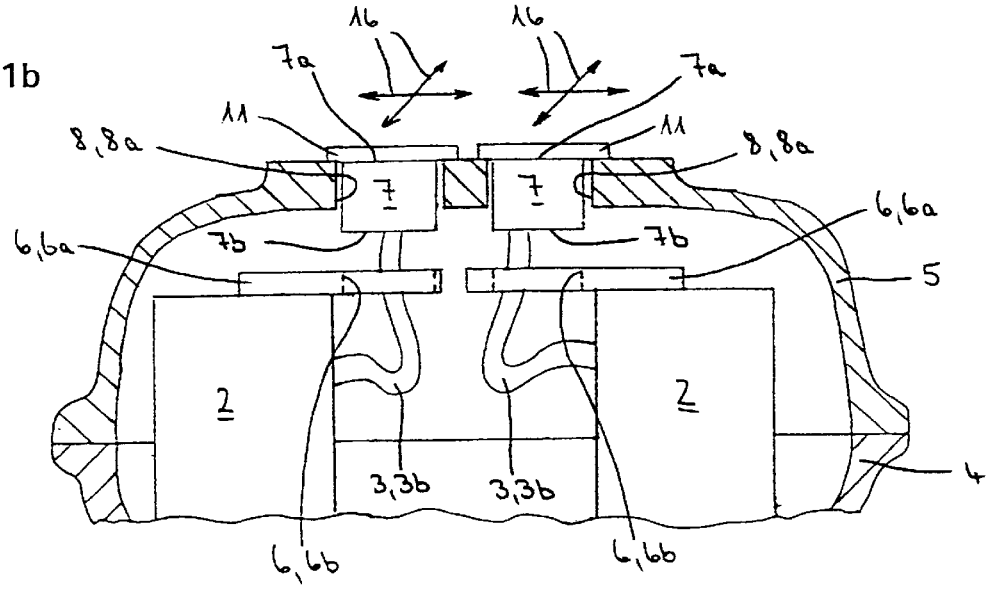
FIG. 1*b* is a cross-sectional view of the device illustrated in FIG. 1*a* during a fixing of the contact-forming housings.
Figure 1C:
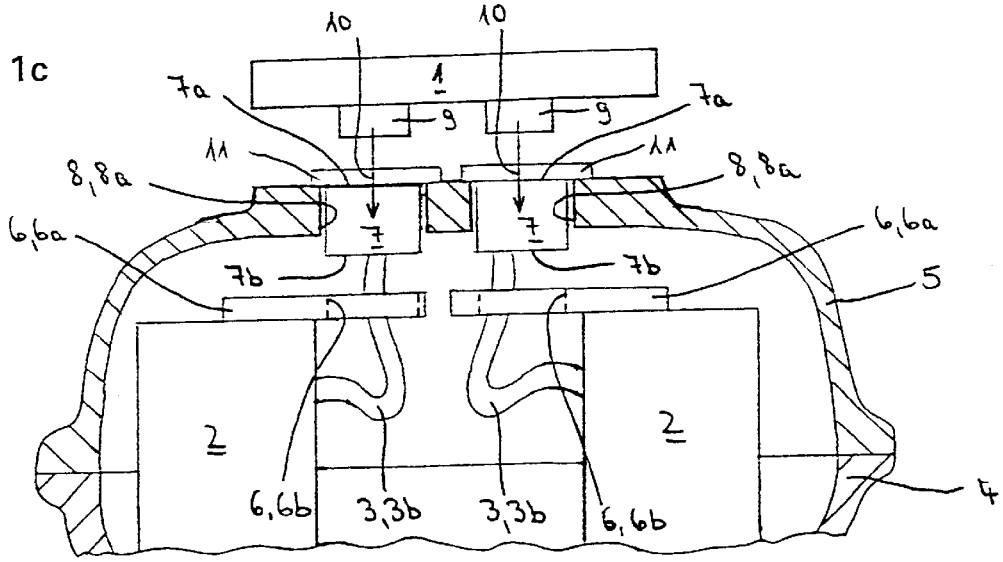
FIG. 1*c* is a cross-sectional view of the device illustrated in FIGS. 1*a* and 1*b* during a formation of contact between actuators and a control unit.
Figure 2A:
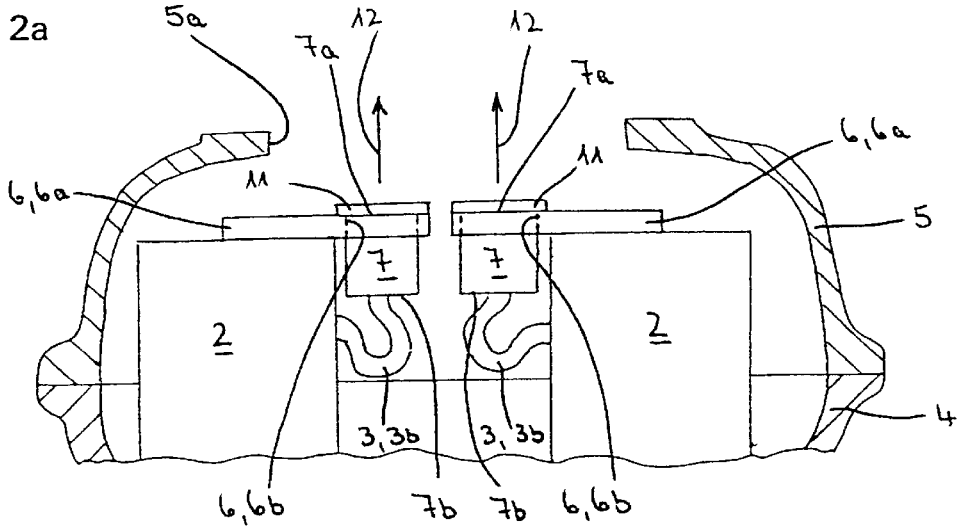
FIG. 2*a* is a cross-sectional view of a second example embodiment of a device according to the present invention during a pre-fixing of contact-forming housings.
Figure 2B:
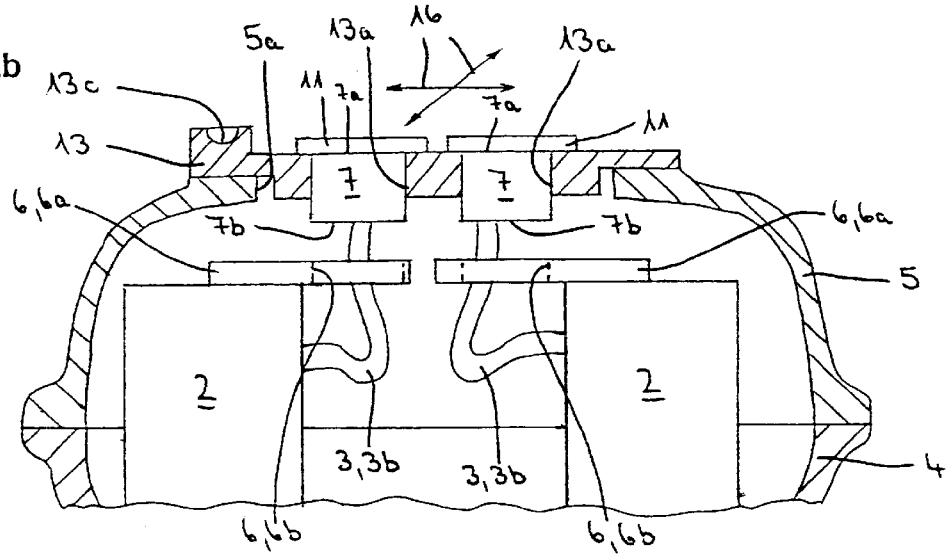
FIG. 2*b* is a cross-sectional view of the device illustrated in FIG. 2*a* during a fixing of the contact-forming housings.
Figure 2C:
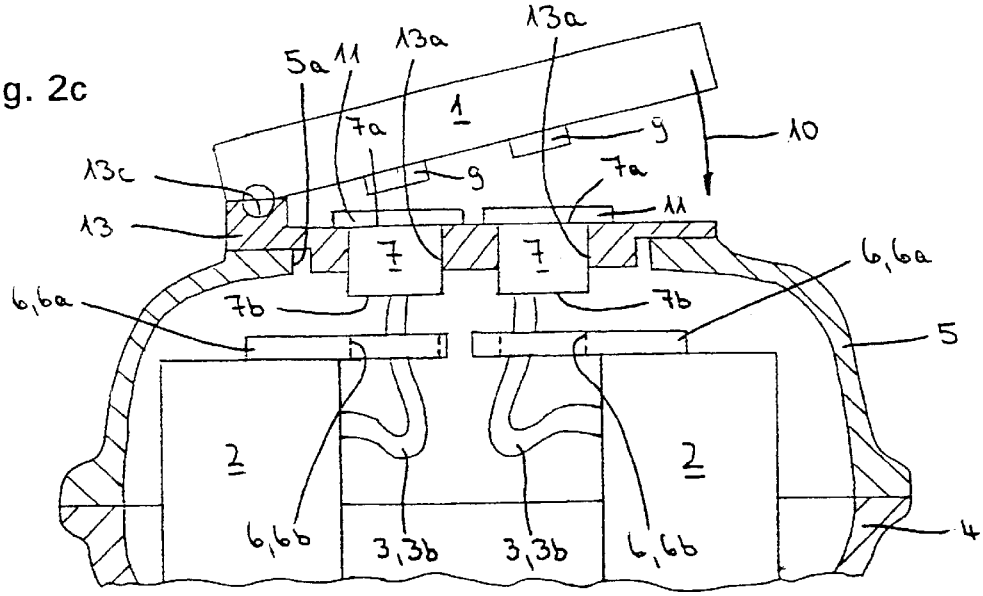
FIG. 2*c* is a cross-sectional view of the device illustrated in FIGS. 2*a* and 2*b* during a formation of contact between actuators and a control unit.
Figure 2D:
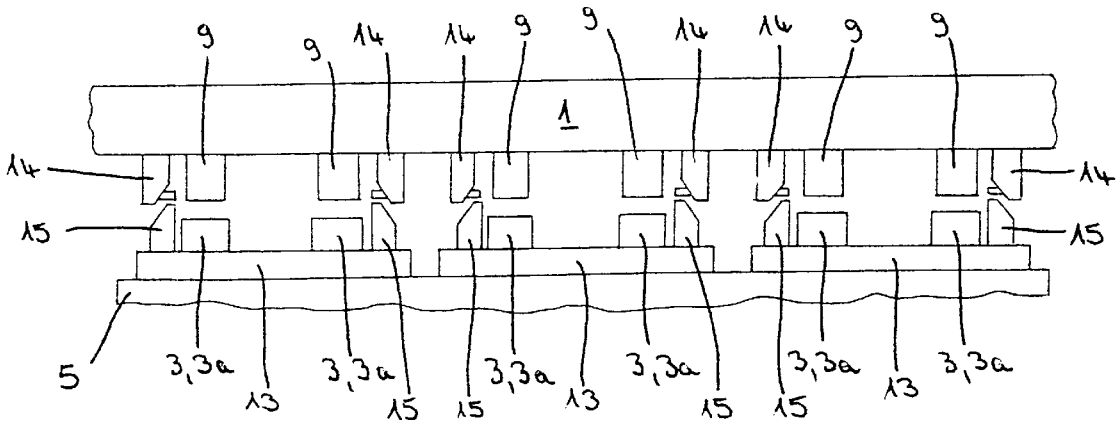
FIG. 2*d* is a side elevational view of the device illustrated in FIGS. 2*a* to 2*c*.
Figure 3:
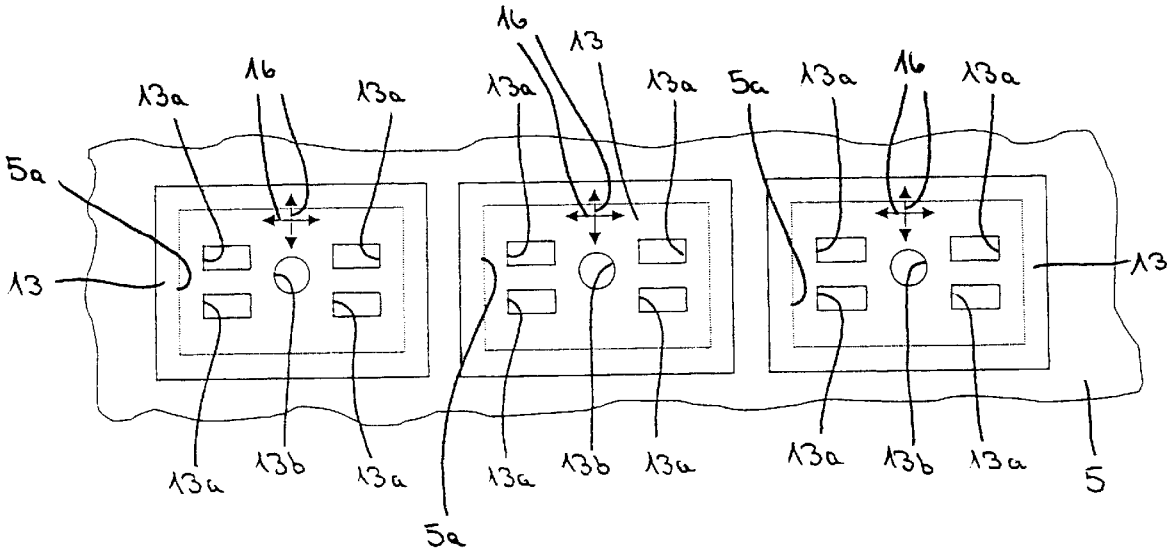
FIG. 3 is a top plan view of the device illustrated in FIGS. 2*a* to 2*d* having a plurality of intermediate frames fitted onto a cylinder head cover.

The fixing device 8 is provided, as illustrated in FIGS. 1*a* to 1*c*, in the form of cutouts 8*a* in the cylinder head cover 5 for receiving the contact-forming housings 7 and, as illustrated in FIGS. 2*a* to 2*d* and 3, of at least one intermediate frame 13 which also includes receptacle openings 13*a* for the contact-forming housings 7 and 13*b* for the ignition coils, the intermediate frame 13 being arranged in an opening 5*a* in the cylinder head cover 5 and being supported on the cylinder head cover 5. The intermediate frame 13 includes a receptacle 13*c* in which the valve control unit 1 may be rotatably latched, axial latching in receptacles of the valve control unit which are provided on the intermediate frame also being possible. In addition, a plurality of intermediate frames, such as, for example, one separate intermediate frame per cylinder of the internal combustion engine, is also possible. FIG. 3 illustrates, for example, a plurality of intermediate frames 13 with the receptacle openings 13*a*, 13*b* for receiving, in each case, one ignition coil and four gas exchange valves per cylinder.

FIG. 2*d* illustrates a centering device which is provided in the form of insertion pins 14 with insertion slopes on the valve control unit 1 and in the form of receiving pins 15 with receiving slopes on the intermediate frames 13, the connection of the pins 14, 15 being made in the form of a clip connection. A similarly configured centering device may also be provided on the cylinder head cover 5 in the first example embodiment.

When contact is formed between the control unit 1 and the current loads, i.e., in particular, the actuators 2 of the internal combustion engine, the contact-forming housings 7 are firstly pre-fixed to the actuators 2 in that the contact-forming housings 7 are inserted into the recesses 6*b* in the securing device 6*a* in the form of a clip connection, the latching elements 11 which are located on the plug side 7*a* preventing the contact-forming housings 7 slipping through in the contact-forming direction 10. Instead of the clip connection, a screwed connection, a locking connection by slides, etc. are also possible. The cylinder head cover 5 is fitted onto the cylinder head 4 of the internal combustion engine. The contact-forming housings 7 are moved out of the pre-fixed position into a fixed position indirectly or directly in the cylinder head cover 5. The contact-forming housings 7 are pulled out of the recesses 6*b* of the securing device 6*a* into the openings 5*a* in the cylinder head cover 5 or into the openings 13*a* in the intermediate frame or frames 13, the latching elements 11 of the contact-forming housings 7 deforming elastically so that it is possible to pull the latching elements 11 through the openings 13*a*. The deformation is reversed so that the latching elements 11 bear on the cylinder head cover 5 or on the intermediate frame 11 and prevent the contact-forming housings 7 moving in the contact-forming direction 10. In order to reduce the tolerances which originate from the actuators 2 and the mounting thereof on the cylinder head 4, the contact-forming housings 7 may move, in a plane 16 extending perpendicularly to the contact-forming direction 10, both directly in the cylinder head cover 5, directly in the openings 5*a* of the cylinder head cover 5, and indirectly in the cylinder head cover 5, via the intermediate frame 13.

The valve control unit 1 is connected to the electrical components 3 of the current loads 2 by plugging the plug 9 of the valve control unit 1 into the current-load-end coupling 3*a* of the contact-forming housing 7. In the first example embodiment illustrated in FIG. 1*c*, the valve control unit 1 is fitted onto the cylinder head cover 5 in a linear movement. Whereas in the second example embodiment illustrated in FIG. 2*c*, the valve control unit 1 which is latched rotatably into the receptacle 13*c* provided on the intermediate frame 13 is pivoted or guided onto the intermediate frame 13 or the electrical components 3.

In order to additionally facilitate the contact formation, the valve control unit 1 and the intermediate frame 13 or the cylinder head cover 5 include the insertion pins 14 and receiving pins 15 which interact and which, during the formation of contact, facilitate the plugging of the plugs 9 into the couplings 3*a*, in particular by the slopes.

A further example embodiment for reducing the tolerances or contact-forming forces includes connecting the control unit 1 permanently to the cylinder head cover 5 and moving the intermediate frames 13 individually, on a cylinder-by-cylinder basis, into the contact-forming position by a lifting device, which is also possible for each individual contact-forming housing 7.

What is claimed is:

1. A method for forming contact between a-control unit and current loads of an internal combustion engine, the contact being formed between the control unit and the current loads in accordance with electrical components through a cylinder head cover seated on cylinder head of the internal combustion engine, the method comprising the steps of:

(a) pre-fixing the electrical components to the current loads in a pre-fixed position;

(b) fitting the cylinder head cover onto the cylinder head;

(c) moving the electrical components one of directly and indirectly out of the pre-fixed position into a fixed position in the cylinder head cover; and (d) connecting the control unit to the electrical components of the current loads.

2. The method according to claim 1, further comprising the step of preventing movement of the electrical components located in the fixed position directly in the cylinder head cover in a contact-forming direction and permitting movement of the electrical components in a plane extending perpendicularly to the contact-forming direction.

3. The method according to claim 1, further comprising the step of preventing movement of the electrical components located in the fixed position indirectly in the cylinder head in a contact-forming direction by an intermediate frame supported in the cylinder head cover and permitting movement of the electrical components in a plane extending perpendicularly to the contact-forming direction.

4. The method according to claim 3, wherein the connecting step includes:

latching the control unit into a receptacle provided on the intermediate frame; and pivoting the control unit onto the electrical components provided in the receptacle.

5. The method according to claim 4, wherein the control unit includes insertion pins configured to latch into corresponding receptacle pins of the intermediate frame when contact is made in the connecting step (d).

6. A device for forming contact between a control unit and current loads of a multi-cylinder internal combustion engine by electrical components, the multi-cylinder internal combustion engine including a cylinder head onto which a cylinder head cover is fittable, comprising:

at least one pre-fixing device attached to the current loads;

at least one contact-forming housing partially enclosing the electrical components; and at least one fixing device provided one of directly and indirectly on the cylinder head cover.

7. The device according to claim 6, wherein the current loads include ignition coils and actuators of an electromagnetic controller, the ignition coils and activators including the electrical components.

8. The device according to claim 6, wherein the electrical components include current-load-end couplings and leads configured to connect the current loads and couplings, at least one coupling being arranged in a contact-forming housing and being configured to receive a plug of the control unit.

9. The device according to claim 6, further comprising a fixing device including an intermediate frame supported on the cylinder head cover, the intermediate frame including openings for at least one of the current loads and the contact-forming housings.

10. The device according to claim 9, wherein a separate intermediate frame is provided for each cylinder of the internal combustion engine.

* * * * *